US007010945B2

(12) United States Patent
Yu

(10) Patent No.: US 7,010,945 B2
(45) Date of Patent: Mar. 14, 2006

(54) DOUBLE-LOCKABLE BAGGAGE CASE

(76) Inventor: Chun-Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/981,453

(22) Filed: Nov. 5, 2004

(65) Prior Publication Data

US 2005/0284198 A1 Dec. 29, 2005

(30) Foreign Application Priority Data

Jun. 25, 2004 (TW) ..... 93210082 U

(51) Int. Cl.
*A45C 13/10* (2006.01)

(52) U.S. Cl. ..... 70/71; 70/285; 70/312

(58) Field of Classification Search ..... 70/69–75, 70/312, 284, 285
See application file for complete search history.

(56) References Cited

U.S. PATENT DOCUMENTS 1,827,060 A * 10/1931 Albert ..... 70/72
3,034,327 A * 5/1962 Garmon, Jr. et al. ..... 70/70
3,135,105 A * 6/1964 Brody ..... 70/71
3,756,639 A * 9/1973 Wilkinson ..... 292/179
4,363,226 A * 12/1982 Remington et al. ..... 70/70
4,365,490 A * 12/1982 Manzoni ..... 70/70
4,395,892 A * 8/1983 Remington ..... 70/312
5,237,842 A * 8/1993 Rasch et al. ..... 70/285
6,540,268 B1 * 4/2003 Pauser ..... 292/48

* cited by examiner

*Primary Examiner*—Suzanne Dino Barrett
(74) *Attorney, Agent, or Firm*—Troxell Law Office, PLLC

(57) ABSTRACT

A double-lockable baggage case including two baggage shells which are pivotally connected with each other along one side and mated with each other to form the baggage case. A main lock device is mounted on one of the baggage shells and includes at least one displaceable latch member. At least one subsidiary lock device and reciprocally movable male fastening member are mounted on the other baggage shell corresponding to the main lock device. The subsidiary lock device includes a driving section. When the subsidiary lock device is turned, the driving section drives and displaces the male fastening member. In a locked state, the male fastening member is locked with the latch member of the main lock device to lock the baggage case. When the male fastening member is responsive of the turning of the subsidiary lock device to displace, the male fastening member is released from the restriction of the latch member of the main lock device for opening the baggage case. Therefore, the baggage case can be unlocked by means of unlocking the main lock device or the subsidiary lock device.

9 Claims, 5 Drawing Sheets

DOUBLE-LOCKABLE BAGGAGE CASE

BACKGROUND OF THE INVENTION

The present invention is related to a double-lockable baggage case meeting the regulation of U.S. customs, and more particularly to a complex double-lockable/unlockable lock device mounted on a baggage case or the like, including both numeral wheel system and key-driven system for controlling locking/unlocking of the baggage case.

The conventional locking apparatuses include numeral system and key-driven system. The numeral system includes numeral wheel type and press key type. These locking apparatuses are widely applied to various daily articles. For example, Taiwanese Patent Nos. 32470 and 46563 and Taiwanese Patent Publication No. 498918, entitled "hanging lock structure (5)" and Taiwanese Patent Publication No. 369068, entitled "hanging lock structure" respectively disclose locking apparatuses pertaining to numeral system and key-driven system applicable to baggage case or suitcase. Taiwanese Patent Publication No. 188528, entitled "belt numeral lock" and Taiwanese Patent Publication No. 457855, entitled "fastener structure of fastening strap of an appliance" disclose numeral locks combined with fastening straps of baggage case or suitcase.

FIGS. 1 and 2 show a typical baggage case or the like 10. The main lock device 11 of the baggage case 10 generally has a numeral wheel system 12 and a key-driven system 13 which together control the locking/unlocking of the baggage case 10. Referring to FIG. 2, several male fasteners 14 are fixed on the other side of the baggage case 10. The male fasteners 14 can be latched in several latch members 121, 131 of the main lock device 11 to lock the baggage case 10. Only when the main lock device 11 is unlocked to permit the latch members 121, 131 to horizontally displace, the baggage case 10 is unlocked.

Practically, it is known that when checked by U.S. customs workers, in case it is found the customs workers that the contents of the baggage case or suitcase are suspicious, the customs workers are authorized by U.S. government to forcedly break off the lock of the baggage case or suitcase and open the same for checking the contents. The damaged lock will be a loss of a user and will lead to trouble and inconvenience to the user, especially during travel. With respect to the baggage case with hard casing, it is hard to modify the design of the body of the baggage case so that the above problem can be hardly overcome.

In order to improve the above situation, U.S. government and customs regulate that the lock manufacturers must provide a standard key for the customs for opening all the locks manufactured by the manufacturers. According to this regulation, some lock manufacturers provide a design for those baggage cases with hard casings. That is, a small box is added to the baggage case, in which a key or unlocking code for unlocking the main lock device 11 is accommodated. The small box is openable by a set key. The lock manufacturers must provide the set key for the customs. In case it is found the customs workers that the contents of the baggage case are suspicious, the customs workers can use the set key to open the small box and take out the key therein for unlocking the main lock device. The above procedure is troublesome. Moreover, the small box itself or the key or the code for unlocking the main lock device 11 may miss during the travel.

SUMMARY OF THE INVENTION

It is therefore a primary object of the present invention to provide a double-lockable baggage case including two baggage shells mated with each other to form the baggage case. A main lock device is mounted on one of the baggage shells and includes at least one displaceable latch member. At least one subsidiary lock device and reciprocally movable male fastening member are mounted on the other baggage shell corresponding to the main lock device. The subsidiary lock device includes a driving section. When the subsidiary lock device is turned, the driving section drives and displaces the male fastening member. In a locked state, the male fastening member is locked with the latch member of the main lock device to lock the baggage case. When the male fastening member is responsive of the turning of the subsidiary lock device to displace, the male fastening member is released from the restriction of the latch member of the main lock device for opening the baggage case. Therefore, the baggage case can be unlocked by means of unlocking the main lock device or the subsidiary lock device.

It is a further object of the present invention to provide the above double-lockable baggage case in which the subsidiary lock device includes a displaceable stopper board. When the subsidiary lock device is turned, the stopper board is responsive of the turning of the subsidiary lock device and vertically biased and released from the restriction of the latch member of the main lock device for opening the baggage case.

The present invention can be best understood through the following description and accompanying drawings wherein:

BRIEF DESCRIPTION OF THE DRAWINGS

FIG. 7 is a perspective view of another embodiment of the subsidiary lock device of the present invention; and FIG. 8 is a perspective view according to FIG. 7, showing the operation of the subsidiary lock device of the present invention.

DETAILED DESCRIPTION OF THE PREFERRED EMBODIMENTS

Figure 1:
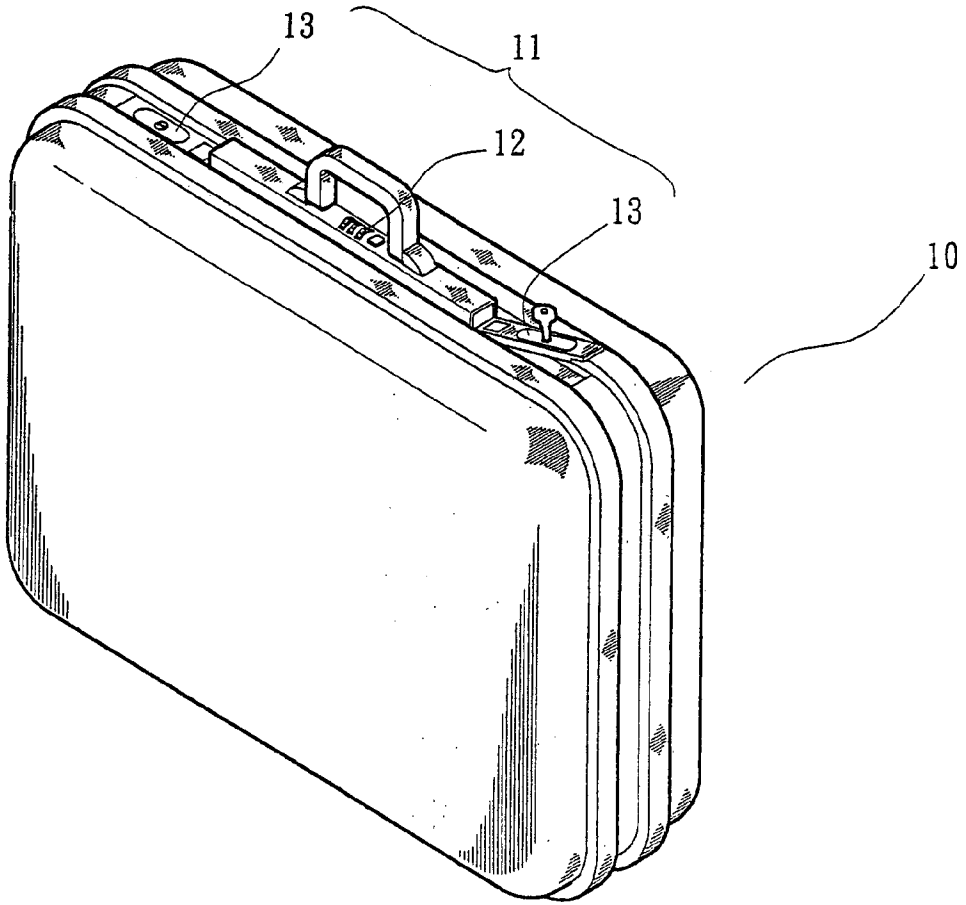
Fig. 1 PRIOR ART
FIG. 1 is a perspective view of a conventional baggage case.
Figure 2:
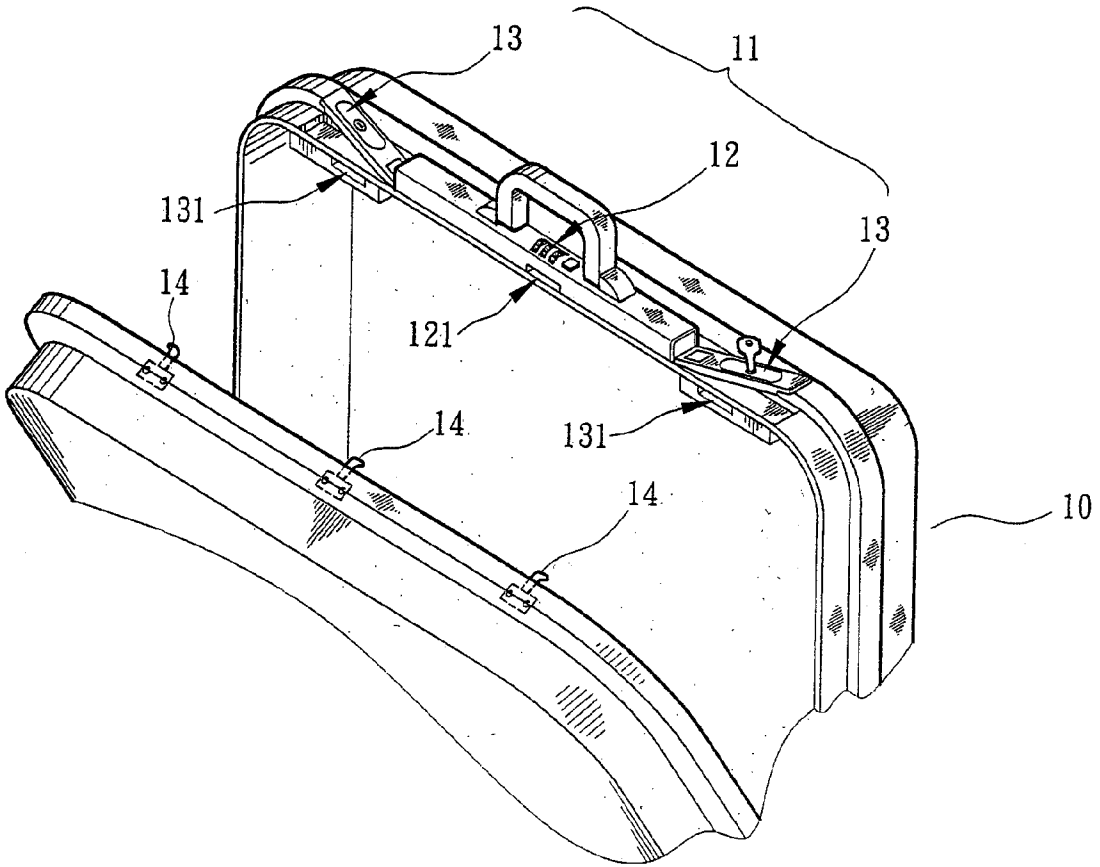
Fig. 2 PRIOR ART
FIG. 2 is a perspective view according to FIG. 1, showing that the baggage case is opened.
Figure 3:
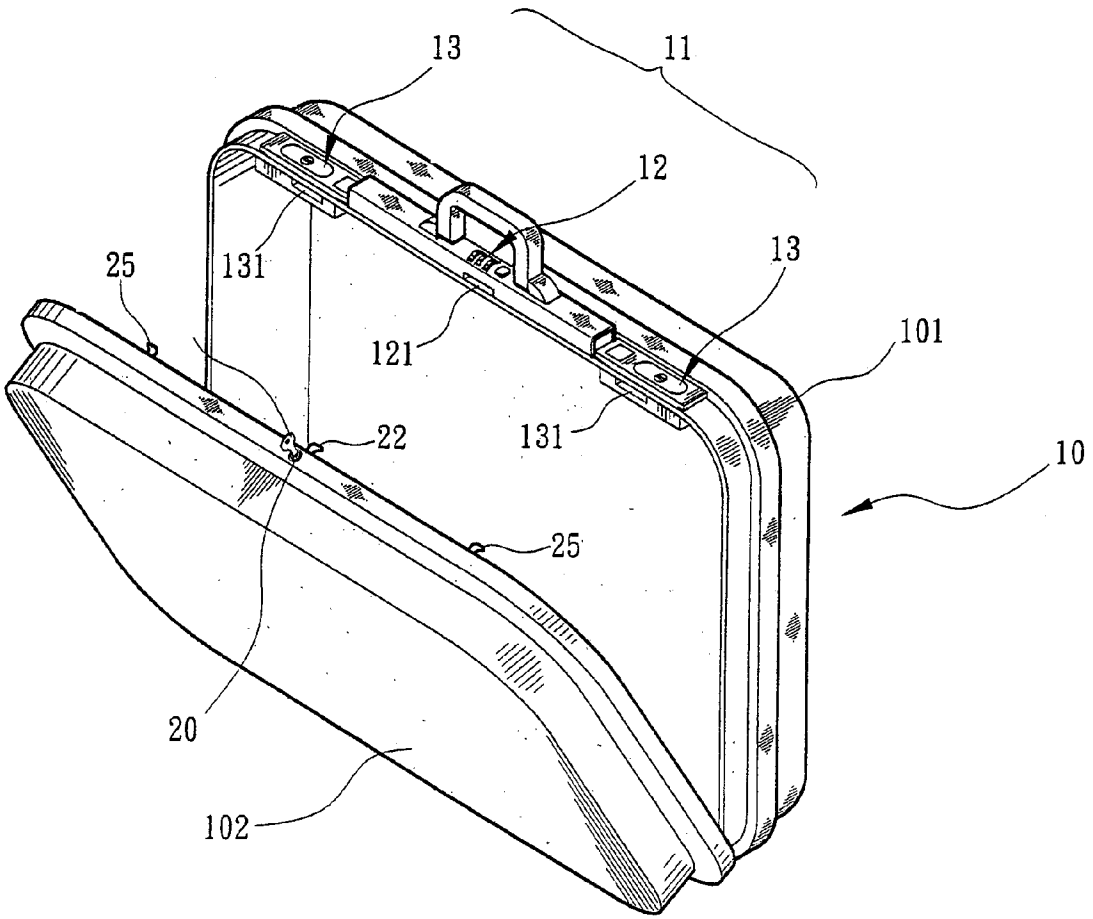
FIG. 3 is a perspective view of a preferred embodiment of the present invention.
Figure 4:
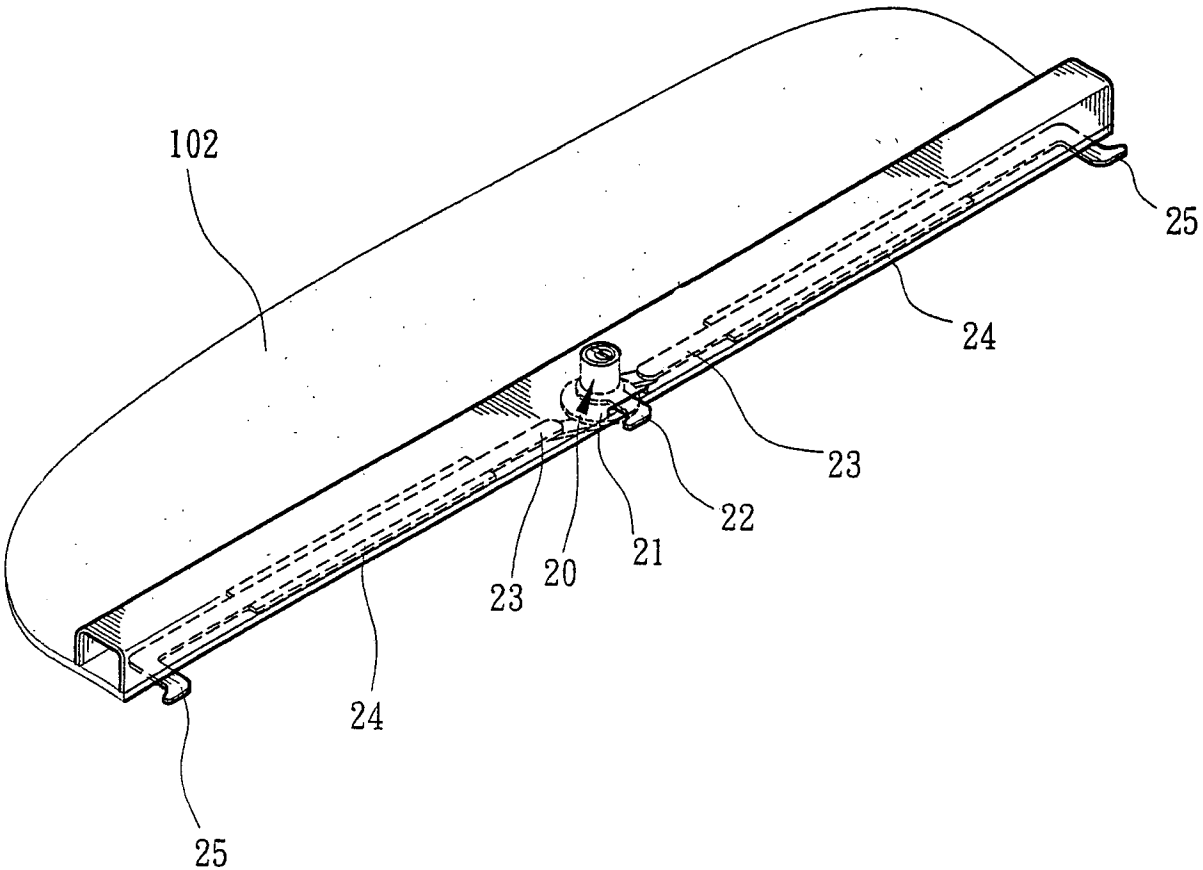
FIG. 4 shows the subsidiary lock device of the present invention.

Please refer to FIGS. 3 and 4. The double-lockable baggage case of the present invention includes two baggage shells 101, 102 pivotally connected with each other along one side and mated with each other to form the baggage case or the like 10. A main lock device 11 is mounted on one baggage shell 101, including at least one numeral wheel system 12 and a key-driven system 13 for together locking/unlocking the baggage case 10. The numeral wheel system 12 and key-driven system 13 respectively have latch members 121, 131. Several male fastening members are disposed on the other baggage shell 102 corresponding to the latch members 121, 131. The numeral wheel system 12 and key-driven system 13 serve to respectively lock the latch members 121, 131 with the male fastening members or release the latch members 121, 131 from the locking for opening the baggage case.

Figure 5:
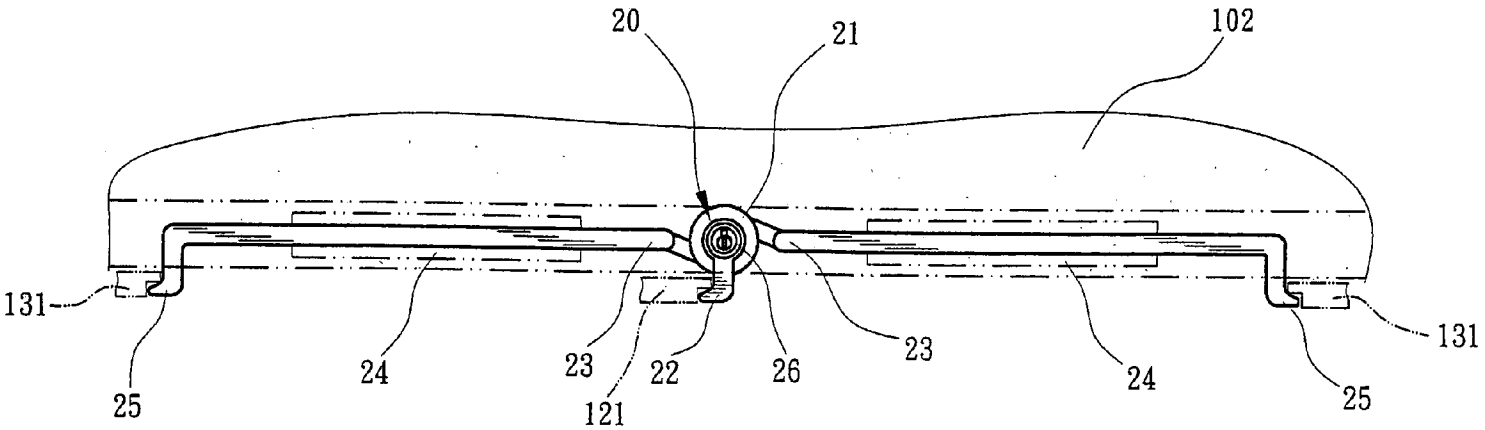
FIG. 5 is a plane view according to FIG. 4.

In this embodiment, at least one subsidiary lock device 20 is mounted on the other baggage shell 102 of the baggage case or the like 10. The subsidiary lock device 20 is unlockable by a set key 30 which is provided for a customs workers to open the baggage case. Referring to FIGS. 4 and 5, the subsidiary lock device 20 includes a reciprocally movable driving section 21 and a male fastening member 22. The driving section 21 can be a cam, a disc or other type of driving member. Two links 23 each having a male fastening member 25 are pivotally connected with two sides of the driving section 21. Each link 23 is reciprocally movable along a rail 24 in a reference direction, whereby the male fastening members 22, 25 can be locked with the latch members 121,131 of the main lock device 11. When the set key 30 is used to turn the subsidiary lock device 20, the male fastening members 22, 25 are unlocked from the latch members 121, 131.

Figure 6:
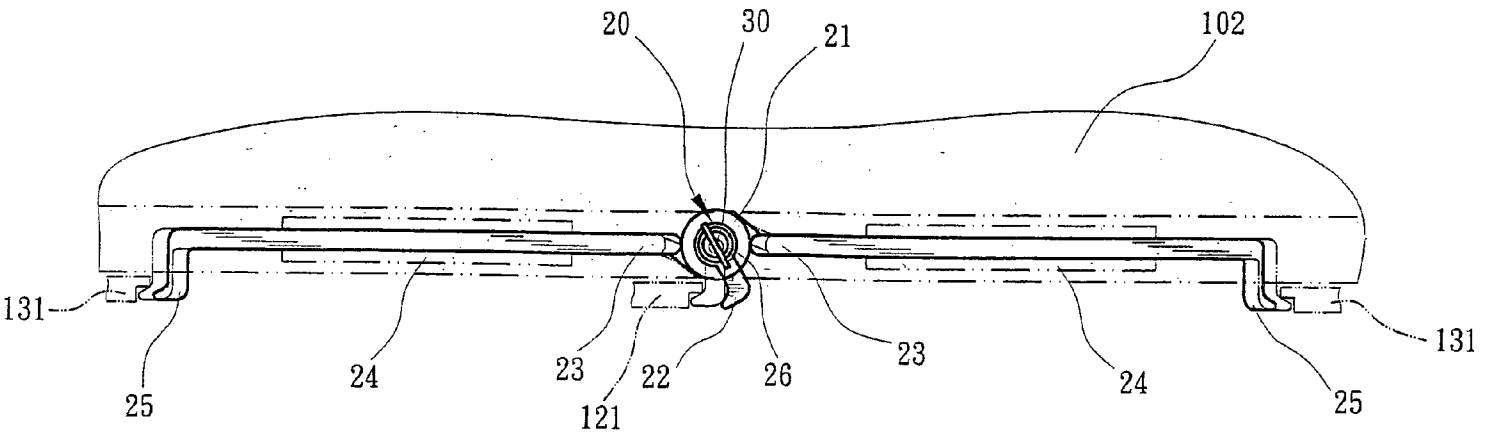
FIG. 6 is a plane view according to FIG. 5, showing the operation of the subsidiary lock device of the present invention.

FIG. 6 shows the operation of the present invention. When the set key 30 is turned to rotate the subsidiary lock device 20, the driving section 21 and the male fastening member 22 are responsive of the rotation of the subsidiary lock device 20 to bias as shown by the phantom line of FIG. 6. Accordingly, the male fastening member 22 will leave the position where the male fastening member 22 is restricted by the latch member 121 of the main lock device 11. Also, the driving section 21 will pull the links 23 to displace along the rails 24 away from each other, whereby the male fastening members 25 will leave the latch members 131. At this time, the baggage shell 102 (such as the baggage cover) of the baggage case 10 can be opened relative to the other baggage shell 101 (such as the baggage body). Only when the set key 30 is turned back or restored by a restoring spring 26 inbuilt in the subsidiary lock device 20, the male fastening members 22, 25 will be again locked with the latch members 121, 131 of the main lock device 11. Under such circumstance, the baggage shells 101, 102 of the baggage case 10 are locked with each other.

In this embodiment, the main lock device 11 pertains to prior art and can be unlocked by an owner of the baggage case or the like 10. The latch members 121, 131 of the main lock device 11 can be displaced and unlocked from the male fastening members for opening the baggage case 10.

FIGS. 7 and 8 show another embodiment of the subsidiary lock device 20 of the present invention, in which the subsidiary lock device 20 includes a stopper board 27 formed with a bolt hole 28. When the stopper board 27 is responsive of the turning of the set key 30 of the subsidiary lock device 20 to vertically bias as shown by the phantom line of FIG. 8, the stopper board 27 is released from the restriction of another type of latch member 121. At this time, the main lock device 11 is unlocked from the bolt hole 28.

The above embodiments are only used to illustrate the present invention, not intended to limit the scope thereof. Many modifications of the above embodiments can be made without departing from the spirit of the present invention.

What is claimed is:

1. A double-lockable baggage case comprising:

a) a first baggage shell;

b) a second baggage shell pivotally connected to the first baggage shell;

c) a main locking device having:

i) at least one numeral wheel system located on the first baggage shell and having a first latch member;

ii) two key-driven systems located on the first baggage shell, each of the two key-driven systems having a second latch member;

iii) a first male fastening member located on the second baggage shell and selectively inserted into the first latch member, the first male fastening member being selectively locked to and released from the first latch member by the at least one numeral wheel system; and iv) two second male fastening members located on the second baggage shell, one of the second male fastening member selectively inserted into each second latch member, one of the second male fastening member being selectively locked to and released from each second latch member by a corresponding one of the two key-driven systems; and d) a subsidiary lock device movable between locked and unlocked positions by a key set and having:

i) two links, one of the two links being connected to each of the two second male fastening members; and ii) a driving section connected to the two links and controlling the first male fastening member and the two second male fastening members, wherein, when the subsidiary lock device is in the unlocked position, the first baggage shell is released from the second baggage shell, and when the subsidiary lock device is in the locked position, the first baggage shell is locked to the second baggage shell.

2. The double-lockable baggage case according to claim 1, wherein the subsidiary lock device having a rail, the two links are movable along the rail.

3. The double-lockable baggage case according to claim 1, wherein the subsidiary lock device includes a stopper board having a bolt hole, the first male fastening member is selectively locked to and released from the bolt hole by the subsidiary lock device.

4. The double-lockable baggage case according to claim 1, wherein the driving section is a cam.

5. The double-lockable baggage case according to claim 2, wherein the driving section is a cam.

6. The double-lockable baggage case according to claim 2, wherein the driving section is a cam.

7. The double-lockable baggage case according to claim 1, wherein the driving section is a disc.

8. The double-lockable baggage case according to claim 2, wherein the driving section is a disc.

9. The double-lockable baggage case according to claim 3, wherein the driving section is a disc.

* * * * *